United States Patent [19]

Sullivan et al.

[11] Patent Number: 4,932,596

[45] Date of Patent: Jun. 12, 1990

[54] COMMINUTING APPARATUS AND METHOD OF MAKING SAME

[75] Inventors: James F. Sullivan, Dallas; Jimmy D. White, Duncanville, both of Tex.

[73] Assignee: Triple/S Dynamics Inc., Dallas, Tex.

[21] Appl. No.: 288,853

[22] Filed: Dec. 23, 1988

[51] Int. Cl.[5] ..... B02C 7/04

[52] U.S. Cl. ..... 241/236; 29/469; 29/525.1; 241/167; 241/291

[58] Field of Search ..... 29/469, 525.1, DIG. 6; 241/166, 167, 235, 236, 291, 301

[56] References Cited

U.S. PATENT DOCUMENTS 4,519,550 5/1985 Rouse ..... 241/DIG. 31
4,560,112 12/1985 Rouse et al. ..... 241/DIG. 31

FOREIGN PATENT DOCUMENTS 2457168 6/1976 Fed. Rep. of Germany ..... 241/236
1299623 3/1987 U.S.S.R. ..... 241/236

*Primary Examiner*—Timothy V. Eley
*Attorney, Agent, or Firm*—Schwartz & Weinrieb

[57] ABSTRACT

Comminuting apparatus for waste and scrap materials such as rubber and worn tires has intermeshed spaced cutters mounted on oppositely rotating shafts. Multi part circular material clearing rings surround the shafts in the spaces between the cutters. The parts of the rings are held together by fasteners that can be removed in the field with simple tools. This eliminates the need for dissassembly of the apparatus and removal of the cutters in order to replace worn or defective clearing rings. Methods of assembling and disassembling the clearing rings are disclosed.

20 Claims, 2 Drawing Sheets

COMMINUTING APPARATUS AND METHOD OF MAKING SAME

BACKGROUND OF THE INVENTION

This invention relates to comminuting machines of the general type disclosed in U.S. Pat. No. 3,931,935 that shred or grind waste materials such as scrap rubber and tires, and more particularly to the loose pendant clearing rings that are supported between the cutter wheels of such machines for preventing the accumaltion of shredded waste between or around the cutting wheels, and to methods of making such clearing rings.

Various mechanisms such as clearing disks, fingers and rings have been used to strip shredded rubber and other scrap materials from the cutter wheels and shafts of comminuting machines. The unitary clearings rings used in prior art apparatus have not been satisfactory because such rings wear out faster than the adjacent parts of the comminuting machine so the rings must be replaced before the other parts require replacement. This has necessitated that the shafts which support the cutter wheels and clearings rings be dissassembled from the comminuting machine, and the cutter wheels and spacers must be removed before new clearing rings can be placed around the shafts. When the cutter wheels and spacers must be removed by pressing them off their supporting shafts, these parts can be damaged to the extent that the parts are not reusable. Prior art clearing rings also generate high noise levels in a range of about 95–100 dBA when the rings contact other parts of the machine during the shredding operation.

OBJECTIVES OF THE INVENTION

Accordingly, it is an object of this invention to provide an improved apparatus for comminuting scrap and waste materials.

Another object is to provide an improved material clearing ring for comminuting apparatus that reduces the noise level adjacent such apparatus.

Another object is to provide a multipart material clearing ring that can be removed from shredding apparatus and replaced with a new clearing ring without requiring removal of the cutting wheels between which the new clearing ring is supported.

Another object is to reduce the down time and expense of removing and replacing worn clearing rings of scrap material comminuting machines.

Another object is to provide comminuting apparatus with material clearing rings that can be easily removed and replaced in the field with simple portable tools, which have a usable life and effectiveness comparable to that of one piece clearing rings, and which do not posses defects found in similar prior art devices.

Another object is to provide improved methods of making, assembling and removing loose pendant clearing rings of material shredders.

Other objects and advantages of the invention will be found in the specification and claims, and the scope of the invention will be set forth in the claims.

DESCRIPTIOON OF THE INVENTION

Figure 1:
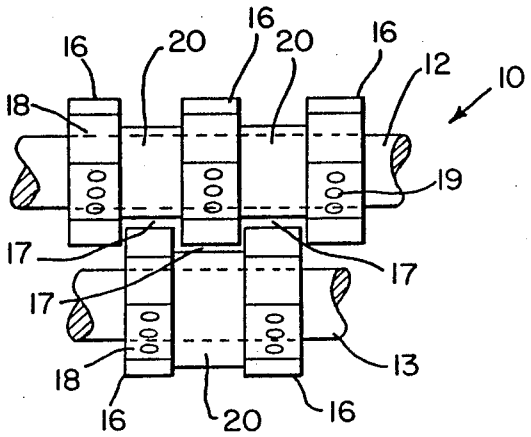
FIG. 1 is a schematic, fragmentary plan view of material comminuting apparatus in accord with this invention.
Figure 2:
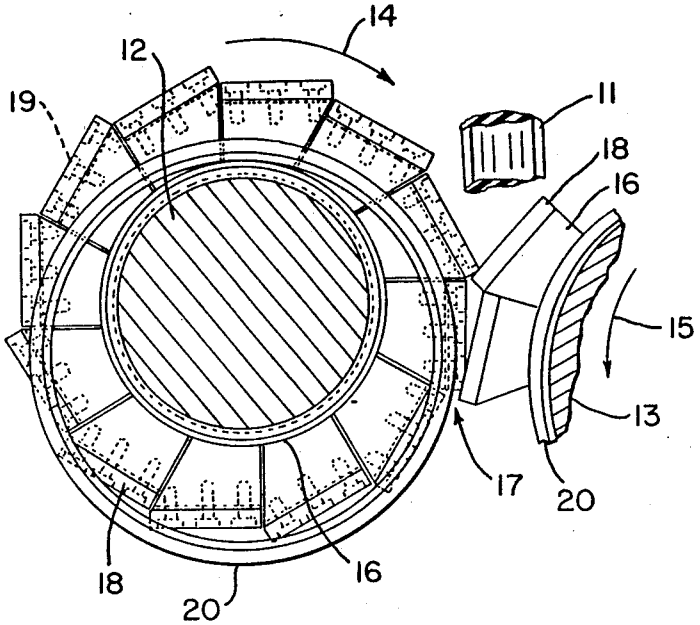
FIG. 2 is an enlarged, partially cross sectional, fragmentary side view of the apparatus of FIG. 1.
Figure 5:
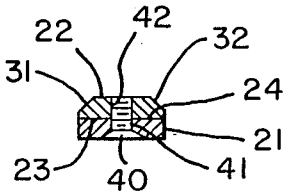
FIG. 5 is a cross sectional view taken along the line 5—5 in FIG. 3.
Figure 4:
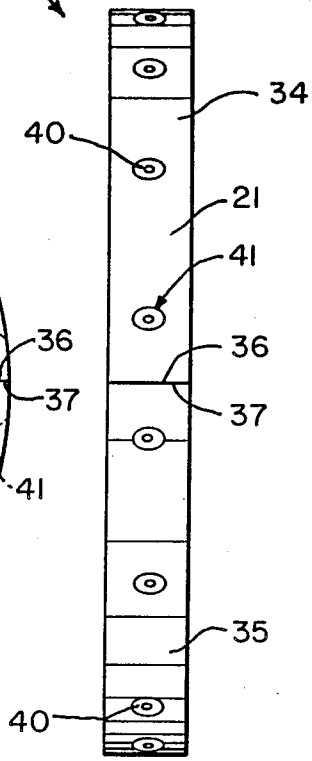
FIG. 4 is an end view of the cleaning ring shown in FIG. 3.
Figure 3:
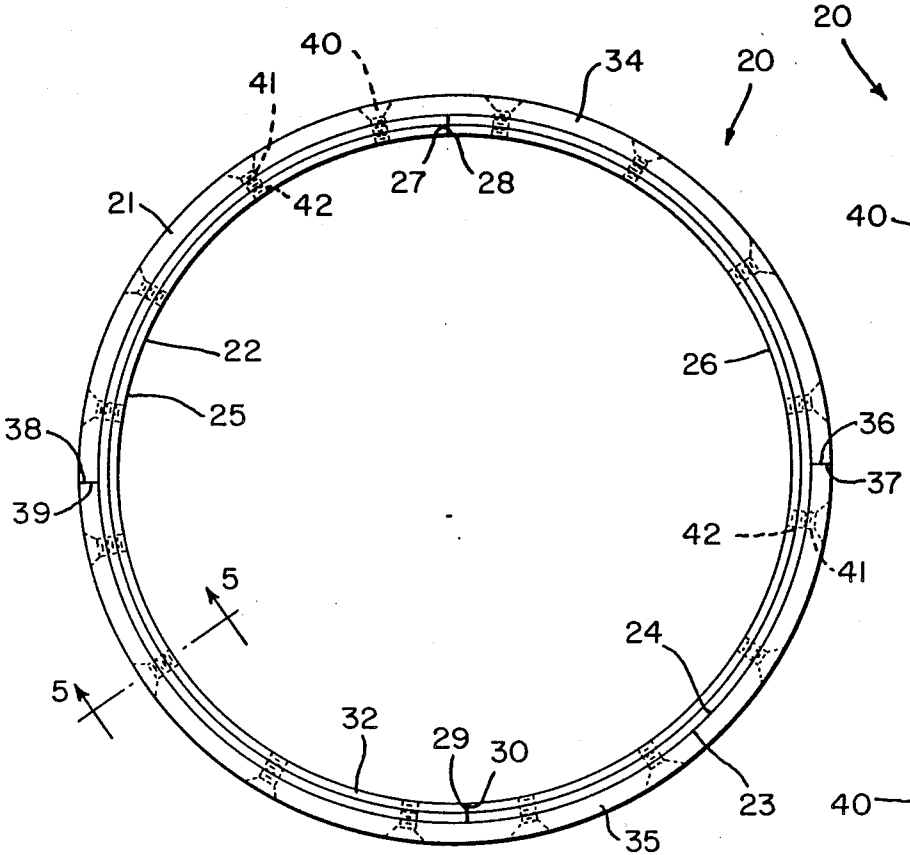
FIG. 3 is an enlarged side view of a material clearing ring from the apparatus of FIGS. 1 and 2 with some parts shown in phantom.

The drawing shows apparatus 10 for shredding or comminuting scrap and waste materials such as rubber and fiber reinforced used tires 11. Apparatus 10 includes a pair of parallel cylindrical shafts 12 and 13 which are rotated in opposite directions as indicated in FIG. 2 by arrows 14 and 15. Each shaft has a plurality of identical, equally spaced, generally circular cutter wheels 16 that are removably attached to the shafts. The adjacent wheels 16 on each shaft define a plurality of spaces 17 between the wheels. The wheels 16 on each shaft extend radially of shafts 12 and 13 into the spaces 17 defined by the wheels 16 on other shaft, as shown in FIGS. 1 and 2, so that the cutters 18 of both shafts overlap or intermesh and cooperate for shredding tires 11. Cutters 18 may be removably attached to wheels 16 by bolts 19 threaded into tapped holes in the wheels.

Spaces 17 also contain identical cylindrical material clearing rings 20 in accord with this invention which surround their respective shafts 12 and 13 for preventing accumulation of the material comminuted by apparatus 10 on or around the shafts and the cutter wheels. Rings 20 are larger in diameter than shafts 12 and 13 and the rings are pendant and freely radially movable around the shafts. The rings 20 should be dimensioned relative to shafts 12 and 13 and wheels 16 such that the rings can push shredded material from between the wheels 16 without having the material trapped between the rings and their respective shafts.

Each clearing ring 20 is made from an outer cylindrical ringlet 21 and an inner cylindrical ringlet 22. Inner ringlet 22 is nested within outer ringlet 21 with the radially outer surface 23 of ringlet 22 on contact with the radially inner surface 24 of ringlet 21. The inner diameter of ringlet 22 is substantially larger than the diameter of shafts 12 and 13. Inner ringlet 22 is made from a pair of approximately identical 180 degree circular inner ring segments 25 and 26, having two pairs of diametrically opposed abutting ends 27 and 28 and 29 and 30. The radially inner edges 31 and 32 of inner ring segments 25 and 26 are chamferred. Outer ringlet 21 is made from a pair of identical approximately 180 degree circular outer ring segments 34 and 35, having two pairs of diametrically opposed abutting ends 36 and 37 and 38 and 39. The pairs of abutting ends 27 and 28 and 29 and 30 of inner ring segments 25 and 26 are circumferentially spaced approximately 90 degrees from the pairs of abutting ends 36 and 37 and 38 and 39 of outer ring segments 34 and 35.

The segments of inner and outer ringlets 21 and 22 are held together by flat headed threaded fasteners 40 that pass through openings or holes 41 in the outer ringlet and engage tapped holes 42 in the inner ringlet. Holes 41 and 42 are radially aligned and should be essentially equally spaced circumferentially around ring 20 except adjacent the four pairs of abutting ends 27 and 28, 29 and 30, 36 and 37 and 38 and 39 where the fasteners 40 should be closer together for increased strength. Preferably, the pairs of aligned holes 41 and 42 adjacent the abutting ends are spaced about -degrees from each other, while the remaining pairs of aligned holes 41 and 42 are spaced about 25 degrees from each other. Fasteners 40 may be flat headed socket machine screws that are easily installed and removed by simple portable power or hand tools.

This invention also includes methods of making, assembling and disassembling clearing rings 20. Inner and outer ringlets 21 and 22 may be made by rolling a flat alloy steel bar to predetermined inner and outer diameters as described above. The inner ringlet 22 is then nested within outer ringlet 21 and the pairs of holes 41 and 42 are drilled along spaced radii. Threads are then tapped in holes 42, and temporary fasteners 40 are screwed in to hold the rings together while the assembly is the heat treated to a predetermined hardness. After heat treatment, the temporary fasteners are removed and the ringlets 21 and 22 are separated. Each ringlet 21 and 22 is cut into two essentially equal 180 degree arcs or segments 25 and 26 and 34 and 35, and the ends 27 and 28 and 29 and 30 of the inner segments 25 and 26 are placed in abuttment with each other. A first outer ring segments 34 or 35 is placed oved a pair of abutting ends of the inner ring segments with the ends 36 and 38 or 37 and 39 of the outer ring segment circumferentially displaced approximately 90 degrees from the pair of abutting ends of the inner ring segment. Fasteners 40 are then passed through the holes 41 and threaded into the tapped holes 42 in the overlapping inner and outer ring segments. The remaining or another outer ring segment 34 or 35 may then be placed over the inner ring segments with the ends of the second ring segment abutting the ends of the first outer ring segment, and fasteners 40 engaged. The pairs of abutting ends of the inner ring segments will be rotated or displaced 90 degrees circumferentially from those of the outer ring segments, which will give the assembly sufficient strength for use as a clearing ring 20 as described. Any ring 20 may be disassembled or removed from apparatus 10 simply by removing fasteners 40, and a dissassembled ring 20 may be installed on comminuting apparatus 10 by placing a pair of inner ring segments 25 and 26 around a shaft 12 or 13 with their pairs of ends 27 and 28, and 29 and 30 in abuttment, and then fastening on ring segments 34 and 35 in the manner set forth above.

It has thus been shown that by the practice of this invention multipart clearing rings 20 can be used instead of uninary prior art clearing rings that required disassembly of the comminuting apparatus for the replacement of worn or damaged rings. When a machine already has unitary clearing rings, such rings can be removed by cutting them apart with a welding torch, and then the segments 25 and 26 and 34 and 35 of rings 20 can be installed around the shafts 12 and 13 in the sequence set forth above. The cutter wheels 16 and any spacers used between wheels 16 need to be moved or removed. Thus, defective or worn clearing rings can be replaced one at a time, or all at once, in the field by using only simple portable tools, and the down time of the machine will be reduced. It has been found that the use of multi-piece clearing rings 20 significantly lowers the sound level of apparatus 10 compared to the use of one-piece clearing rings because of the sound damping effect of the interface of surfaces 23 and 24 between ringlets 21 and 22, and the interruption of the continuity of the ringlets at their abutting ends 27 and 28, 29 and 30, 36 and 37, and 38 and 39.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. Apparatus for comminuting scrap and waste materials, comprising:

(A) a pair of oppositely rotating parallel shafts each having a plurality of axially spaced, generally circular cutter wheels fastened thereon for rotation with their respective shafts, the adjacent cutter wheels of each shaft defining a plurility of spaces therebetween, and the cutter wheels of each shaft extending radially into the spaces defined by the cutter wheels of the other shaft so that the cutter wheels of both shafts intermesh and cooperate for communiting said waste materials; and (B) a plurality of cylindrical clearing rings surrounding each shaft, said clearing rings being larger in diameter than said shafts and being freely radially movable around said shafts, said clearing rings being located in said spaces between the adjacent cutter wheels of each shaft, each clearing ring comprising an outer cylindrical ringlet and an inner cylindrical ringlet nested within said outer ringlet, and means for fastening said inner and outer ringlets together so as to enable said inner and outer ringlets to be separated from each other and said clearing rings to be removed from and installed on said shafts without requiring removal of said cutting wheels from said shafts.

2. The invention defined in claim 1, further comprising said inner ringlet comprising a plurality of inner ring segments each of which is fastened to said outer ringlet.

3. The invention defined in claim 2, wherein said inner ring segments comprise a pair of ring segments each of which is approximately 180 degrees.

4. The invention defined in claim 1, further comprising said outer ringlet comprising a plurality of outer ring segments each of which is fastened to said inner ringlet.

5. The invention defined in claim 4, wherein said outer ring segments comprise a pair segments each of which is approximately 180 degrees.

6. The invention defined in claim 1, further comprising said inner ringlet comprising a plurality of inner ring segments and said outer ringlet comprising a plurality of outer ring segments.

7. The invention defined in claim 1, further comprising said inner ringlet comprising a pair of inner ring segments each of which is approximately 180 degrees, and said outer ringlet comprising a pair of outer ring segments each of which is approximately 180 degrees.

8. The invention defined in claim 7, wherein said inner ring segments have a pair of abutting ends.

9. The invention defined in claim 7, wherein said outer ring segments have a pair of abutting ends.

10. The invention defined in claim 7, wherein said inner and outer ring segments each have pairs of abutting ends.

11. The invention defined in claim 10, wherein said pairs abutting ends of said inner ring segments are circumferentially spaced from said pairs of abutting ends of said outer ring segments.

12. The invention defined in claim 11, wherein said pairs of abutting ends of said inner ring segments are cirsumferentially spaced approximately 90 degrees from said pairs of abutting ends of said outer ring segments.

13. The invention defined in claim 1 wherein said means for fastening said ringlets together comprises a plurality of circumferentially spaced tapped holes in said inner ringlet that are radially aligned with circumferentially spaced openings in said outer ringlet, and removable fasteners passing through said openings are threaded into said tapped holes.

14. The invention defined in claim 1, wherein said inner ringlet has its radially inner edges chamferred.

15. A cylindrical material clearing ring for freely movably surrounding a rotatable shaft between spaced cutter wheels affixed to said shaft, comprising: an inner cylindrical ringlet nested within an outer cylindrical ringlet, said inner ringlet comprising a pair of 180 degree ring segments having two pair of abutting ends, said outer ringlet comprising a pair of 180 degree ring segments having two pairs of abutting ends, said pairs of abutting ends of said inner ring segments being displaced circumferentially from said pairs of abutting ends of said outer ring segments, there being a plurality of circumferentially spaced tapped holes in said inner ring segments that are radially aligned with circumferentially spaced openings in said outer ring segments, and removable fasteners passing through said openings and threaded into said tapped holes.

16. The invention defined in claim 15 wherein said pairs of abutting ends of said inner and outer ring segments are circumferentially displaced approximately 90 g degrees.

17. The method of making a cylindrical clearing ring that surrounds a rotatable shaft between spaced cutter wheels affixed to said shaft, comprising the steps of:

(A) making an inner cylindrical ringlet having a predetermined outer diameter and having an inner diameter greater than that if said shaft;

(B) making an outer cylindical ringlet having an inner diameter slightly larger than said outer diameter of said inner ringlet;

(C) nesting said inner ringlet within said outer ringing;

(D) drilling radial aligned holes through said nested ringlets;

(E) tapping threads in said holes of said inner ringlet;

(F) separating the nested ringlets;

(G) cutting each ringlet into a plurality of ring segments;

(H) abutting the ends of a pair of said inner ring segments;

(I) placing a first of said outer ring segments over said pair of inner ring segments with the ends of said outer ring segment being displaced circumferentially from said abutting ends of said pair of inner ring segments;

(J) passing fasteners through said holes in said first outer ring segment and threading said fasteners into said tapped holes in both of said pair of inner ring segments;

(K) placing another outer ring segment over other of said inner ring segments; and (L) passing fasterners through said holes in said another outer ring segments and threading said fasteners into said tapped holes in both of the other inner ring segments.

18. The invention defined in claim 17 further comprising performing the following steps between steps E and F:

(A) termporarily assembling said ringlets together by passing fasteners through said holes in said outer inglet into said tapped holes in said inner ringlet;

(B) heat treating the assembly of ringlets to a predetermined hardness; and (C) removing said fasteners and separating said inner and outer ringlets.

19. The invention defined in claim 17, further comprising cutting each of said inner and outer ringlets into two ring segments each of which is approximately 90 degrees.

20. The invention defined in claim 19, further comprising displacing said end of said outer ring segment approximately 90 degrees from said abutting ends of said inner ring segments.

* * * * *